US006422036B1

(12) United States Patent
Giannis et al.

(10) Patent No.: US 6,422,036 B1
(45) Date of Patent: Jul. 23, 2002

(54) JEWELRY CLASP

(75) Inventors: Donna Giannis, Bannockburn; Roseann Espino, Chicago, both of IL (US); Marianna Tsakas, Athens (GR)

(73) Assignee: Tough Cookies, Inc., Chicago, IL (US)

( * ) Notice: Subject to any disclaimer, the term of this patent is extended or adjusted under 35 U.S.C. 154(b) by 0 days.

(21) Appl. No.: 09/417,942

(22) Filed: Oct. 13, 1999

(51) Int. Cl.[7] ..... A44C 5/00
(52) U.S. Cl. ..... 63/3.1; 63/3; 63/3.2
(58) Field of Search ..... 63/1.11, 1.16, 63/1.17, 3, 3.1, 3.2, 4, 21, 23, 41

(56) References Cited

U.S. PATENT DOCUMENTS 151,844 A * 6/1874 Church ..... 63/20
229,257 A * 6/1880 King ..... 63/21
1,446,179 A * 2/1923 Henkes ..... 63/23
1,494,680 A * 5/1924 Fisk ..... 24/573.5
1,853,387 A * 4/1932 Vetter ..... 24/600.9
3,208,238 A * 9/1965 Spitzer ..... 63/3.1
4,611,368 A * 9/1986 Battersby ..... 24/116 R
5,214,940 A * 6/1993 Capifali ..... 63/21
5,341,659 A * 8/1994 Wright ..... 63/1.16
5,687,585 A * 11/1997 Ferrell ..... 63/21
5,722,260 A 3/1998 Mangano

* cited by examiner

*Primary Examiner*—B. Dayoan
*Assistant Examiner*—Andrea Chop
(74) *Attorney, Agent, or Firm*—Welsh & Katz, Ltd.

(57) ABSTRACT

The present invention concerns a jewelry clasp, for use with necklaces, bracelets and other chain jewelry. The clasp comprises a receptacle, having two parts with a plurality of anchors attached to the inside surfaces of the receptacle. The receptacle may be opened to allow the attachment of chains within the box and then closed and locked to secure the chains. The anchors allow the holding of the ends of a number of pieces of chain jewelry by the clasp. The ends of various pieces of chain jewelry may be attached to any number of the anchors to form new configurations of jewelry. The receptacle may be made to appear decorative so that, if desired, the clasp may be large to facilitate its use and to allow for any number of chain anchors so that the user may attach any number of jewelry chains in a decorative manner.

13 Claims, 3 Drawing Sheets

JEWELRY CLASP

FIELD OF THE INVENTION

The present invention concerns a novel jewelry clasp that allows chain based pieces of jewelry to be combined together to form a number of different types of jewelry.

BACKGROUND OF THE INVENTION

The use of chains as jewelry to hold precious stones, semi-precious stones, pearls, medals and other ornamentation has been one of the most popular forms of personal decoration in history. Chains have been used as necklaces and bracelets, to hold prayer beads, worry beads and pocket watches and as other forms of jewelry.

Chain based jewelry generally is provided with a clasp that connects the ends of a chain together to form a necklace, bracelet or other form of jewelry. In the past, the clasp of such jewelry allowed the jewelry to be worn only for the function for which it was designed. A necklace chain could only be worn as a necklace and a bracelet could only be worn as a bracelet. Further, these clasps have generally been designed to allow the connection of one end of a chain to the other, so that no variation of jewelry could be made. The clasps of these chains generally comprises some variation of male and female pieces, one on each end of a chain, that mechanically fit together to form a necklace or bracelet. Such items as a hook and eye, spring catch and ring, or bolt ring and ring, are common means used to form chain jewelry. These clasps are generally made so as to blend in with the chain so that the clasp will not be noticed.

Jewelry clasp are generally utilitarian device that when worn are worn out of sight, usually behind the neck or on the underside of the wrist, and therefore need not be aesthetically pleasing. Generally, a clasp has not been considered as part of the jewelry, but instead, has been considered as merely a means to fasten the ends of a chain together to form the jewelry. Because of this, and so as to allow the clasp to blend in with the chain, clasps have generally been made very small.

Because of their small size clasps generally cannot be made very strong and often times they will break causing the loss of the jewelry, or the suffering of expensive repair bills. Further, because clasps are made small, they are often difficult to see and can be difficult, particularly for older persons or those with disabilities such as arthritis, to manipulate. Often times, as a result of the size of the clasp, a piece of jewelry is not worn because the clasp is too difficult to use. Also, jewelry has been lost because it had been thought that the clasp was secure when, because of its small size, it could not be seen that it had not been secured.

We have invented a new type of clasp that allows for variations in the manner that jewelry is secured so that for example a bracelet may be reconfigured to be worn as a part of a necklace or an additional piece of jewelry may be added to a necklace or bracelet to change the character of the jewelry or form a unique piece of jewelry. Our clasp can be made relatively large, and yet remain decorative, so that the user can easily manipulate the clasp, check the clasp for security and wear the clasp as part of the jewelry. Further, our clasp allows the user to combine various pieces of chain jewelry together to make new jewelry configurations. Our clasp also allows the addition of pendants, fobs and other jewelry items to make new necklaces, bracelets and other jewelry combinations. In one embodiment of our clasp, we have increased the size of the clasp and made it decorative so that different combinations of jewelry may be made and the clasp may be included as a decorative aspect of the jewelry combination. We have also found that our clasp may be used to replace the clasp originally provided with a piece of chain jewelry, thus either effecting a quick repair or making the jewelry more fashionable by the addition of a decorative clasp.

It is therefore an object of the present invention to provide a jewelry clasp that can be used to reconfigure existing jewelry into new jewelry pieces.

It is another object of the present invention to provide a decorative jewelry clasp that may be made large so that use of the clasp is facilitated.

It is a further object of the present invention to provide a jewelry clasp that is easy to open and close and is strong and durable.

It is a further object to provide a clasp that forms part of the decoration of the jewelry and which can be worn so that reaching the clasp for manipulation, attachment or removal, of the jewelry is made convenient to the wearer.

It is a further object of the present invention to provide a jewelry clasp that allows the connection of multiple jewelry chains, pendants, fobs or other pieces of jewelry to allow the user to manipulate such individual pieces of jewelry together to arrive at new jewelry combinations.

Other objects and advantages of the present invention will become apparent as the description proceeds.

SUMMARY OF THE INVENTION

In accordance with the present invention, a jewelry clasp, for use with jewelry chains is provided. The clasp comprises a receptacle having a first portion and a second portion connected to each other. A plurality of anchors are defined in the interior walls of the first and second portions of the receptacle for holding the ends of jewelry chains, such that the jewelry chains may be manipulated, within the clasp, to form a plurality of jewelry configurations.

In the illustrative embodiments, the clasp is generally a hollow box divided into two portions; the portions being rotatably connected to each other by a hinge and being lockable together by conventional means. In the preferred embodiment the second portion comprises a lid and the first portion comprises the remainder of the box. On the inside wall of the second portion of the box, two anchor points, comprising hooks attached to the inner wall of the box, are provided. On the inside wall of the first portion, a single anchor is provided. In the illustrative embodiments, the two hooks on the second portion of the box have their connection points disposed downwardly so that the clasp may be suspended from a chain attached to the two anchor points. The hook on the first portion of the box has its connection point disposed upwardly so that a pendant, or other object, may be suspended from the clasp when the Jewelry is worn.

In the preferred embodiment, the top of the clasp defines openings which allow the two ends of a chain to be anchored within the clasp and emerge from the clasp. The bottom of the clasp defines an opening allowing a pendant, or another chain, to be attached within the clasp and emerge from the clasp. In the illustrative embodiments, when the clasp is in the closed position, the ends of the chain and pendant are inaccessible and the chain and pendant are secured.

In the preferred embodiment, the clasp has been designed in a generally kidney shaped form for decorative purposes. It is to be understood that the clasp may take any decorative form, such as circular, rectangular or heart-shaped, without departing from the novel scope of the present invention.

In the preferred embodiment of the present invention, three anchors, as described above, are provided and are placed so that when the clasp is in the closed position, the anchors are in a triangular relationship. In this way the anchors do not touch each other and there is room for chains to be attached to each without becoming entangled.

In the illustrative embodiments of the invention, a hasp-like device is provided on one portion of the clasp and a knob is provided on the other portion, such that when the first and second portion of the receptacle are rotated together, the clasp may be locked to secure the jewelry chains within the box. It is to be understood, however, that any form of locking device or jewelry safety catch may be provided without departing from the novel scope of the present invention. It is to be further understood that the hinge described above may be replaced by another hasp and knob, or other locking means, and that the first and second portions of the clasp may be separate pieces that may be fit together and locked in two places.

The illustrative embodiments include a method of wearing a necklace, using the clasp of the present invention, such that the clasp is worn on the chest in a decorative manner. In this way, the clasp acts as a decoration, while allowing the wearer easy access so that the chains may be manipulated, the jewelry may be easily secured, and later, when desired, removed.

A more detailed explanation of the invention is provided in the following description and claims and is illustrated in the accompanying drawings.

DETAILED DESCRIPTION OF THE ILLUSTRATIVE EMBODIMENT

Figure 1:
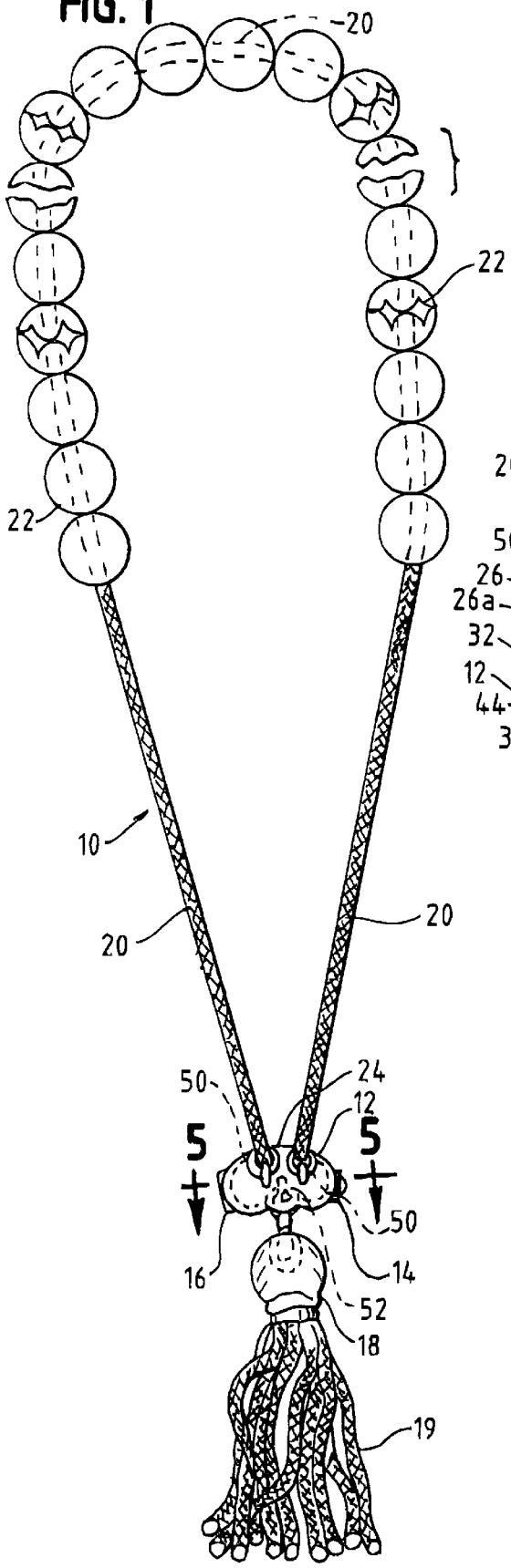
FIG. 1 is a perspective view, partially cut away, of a clasp made in accordance with the principles of the present invention, shown in association with a chain of beads and a pendant, the clasp and beads are broken away to show the connection of the chains within the clasp and the passage of the chain through the beads.

Referring to the drawings, FIG. 1 shows a piece of chain jewelry 10 comprising a clasp 12, having a lock 14 and a hinge 16. Attached to clasp 12 is a pendant 18 and a chain 20. Chain 20 is provided with decorative beads 22. Clasp 12 comprises a receptacle 24 having two portions, 26 and 28, which are rotatably attached together by hinge 16. The two portions 26, 28, of receptacle 24 may be locked together by lock 14, comprising a hasp 30 and a knob 32. In the illustrative embodiment, clasp 12 is constructed of silver, it is to be understood, however, that clasp 12 may be constructed of any precious metal, including gold and platinum, or may be constructed of other metals such as steel, aluminum, titanium or may be constructed of plastic materials, or may be made of natural materials such as bone or wood, without departing from the novel scope of the present invention.

Figure 2:
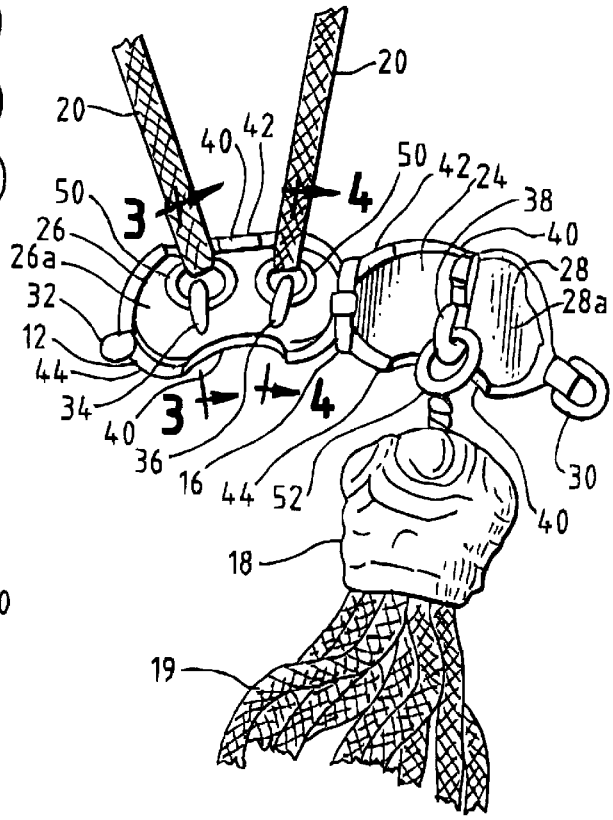
FIG. 2 is a perspective view of the clasp of FIG. 1, shown in an open position.

In FIG. 2, clasp 12 is shown having three anchors 34, 36 and 38 which are connected, respectively to a chain 20 and pendant 18. As shown, in FIG. 2, anchors 34 and 36 are defined on the inside walls 26*a* of portion 26 of receptacle 24 and anchor 38 is defined on inside wall 28*a* of portion 28 of receptacle 24. FIG. 2 further illustrated that cut outs 40 have been defined in the top walls 42 and bottom walls 44 of receptacle 24 to allow chain 20 and pendant 18 to move freely within clasp 12. When portions 26 and 28 are rotated closed, cut outs 40, formed on each portion or receptacle 24, define a generally oval opening 43 (FIG. 6) in the top wall 42 of clasp 12 and one generally oval opening 45 (FIG. 5) in the bottom wall 44 of clasp 12. Further, the rotation of portions 26 and 28 to the closed position, as shown in FIG. 1, causes chain 20 and pendant 18 to be secured within clasp 12, such that chain 20 and pendant 18 cannot be dislodged from their respective anchors.

While the illustrative embodiment shows that class 12 is provided with a lock 14, comprising a hasp 30 and a knob 32, it is to be understood that other methods of securing the clasp may be used without departing from the novel scope of the present invention. Such security devices may include devices housed within clasp 12 which prevent the separation of portions 26 and 28 of receptacle 24 unless the security device is manipulated by the wearer. Such security devices are well known in the art, and may be easily included within clasp 12.

Metal chain 20 is constructed with eyelets 50 (FIG. 2) at each end, in a manner common to chain jewelry, to allow for the connection of metal chain to a clasp 12. It is to be understood that an ordinary piece of chain jewelry having means to connect the ends of the chain to an anchor, or hook, may be used without departing from the novel scope of the present invention. It is to be further understood that the chain may be decorated with any type of stone or jewel, or no decoration at all, without departing from the novel scope of the present invention. It is also to be understood that a broken chain may be attached to the clasp of the present invention by an actual link 54 (FIGS. 3 and 4) in the chain rather than an eyelet or other connection device. In this manner, the user may use a broken chain without having repairs made. Decorative pendant 18 is provided with an eye 52 to allow its connection to anchor 38. While pendant 18 may take any shape, in the illustrative embodiment, pendent 18 is a decorative tassel which swings from clasp 12 from a position oppositely disposed from chain 20.

The illustrated jewelry is a set of OPA BEADS™ 10, made by Tough Cookies, Inc. OPA BEADS™ 10 comprise a plurality of beads 22 on metal chain 20, with a section of chain 20 left uncovered by beads 22 and a pendant 18 having tassels 19. OPA BEADS™ 10 are a type of "worry bead" which can be used by the owner for any desired purpose. Worry beads are generally held in the hand while the beads 22 are manipulated, counted or played with. For this purpose pendant 18 allows the user to hold onto the OPA BEADS™ 10. The OPA BEADS™ 10 may be worn around the neck as a necklace or may be wrapped around the wrist as a bracelet. In any of these uses, pendant 18 may be added or removed to provide the appropriate degree of decoration. OPA BEADS™ 10 may be worn in the manner shown in FIG. 7, or pendant 18 may be removed and clasp 12 may be placed behind the neck so that OPA BEADS™ 10 may be worn as a conventional necklace.

Figure 3:
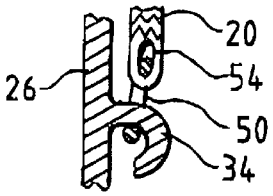
FIG. 3 is a cross-sectional view, taken along the plane of line 3—3 of FIG. 2, showing the manner in which a chain may be connected to the clasp of FIG. 1.
Figure 4:
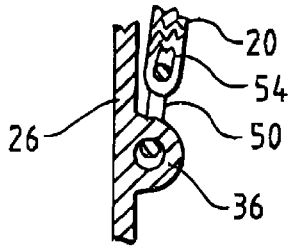
FIG. 4 is a cross-sectional view, taken along the plane of line 4—4 of FIG. 2, showing another manner in which a chain maybe connected to the clasp of FIG. 1.

Referring to FIG. 2, the clasp 12 of the present invention is shown in an open position, allowing access to the eyelets 50 of chain 20 and the eye 52 of pendant 18. In the configuration shown in FIG. 2, one eyelet 50 of chain 20 is merely removably hooked onto anchor 34, as shown in FIG. 3, while the other eyelet 50 is permanently attached within anchor 36, as shown in FIG. 4. Permanent attachment of clasp 12 to chain 20 through anchor 36 provides security for clasp 12. Pendant 18 is shown removably hooked to anchor 38. In the preferred embodiment, shown in FIG. 8, all of the anchors of clasp 70 are of a type similar to anchors 34, and 38, of FIG. 2. In this way, all parts of the chain 20 and pendant 18 may be removably attached to clasp 70. In FIG. 2, clasp 12 is permanently attached to chain 20 such that together they form an integrated piece of jewelry that can be configured as a necklace, bracelet or long chain for such use as a pocket watch chain. Further, another chain may be attached to the free end of chain 20, using the general method of hooking the male and female ends of different chains together (or utilizing another clasp of the present invention), to increase its length for utility or fashion purposes. It is to be understood that any combination of removably and permanently attachments may be made without departing from the novel scope of the present invention.

Figure 5:
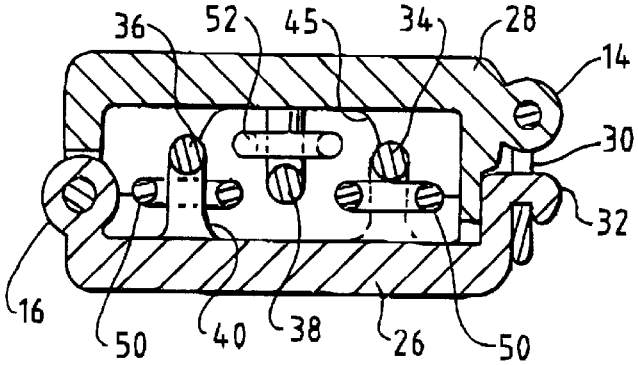
FIG. 5 is a cross-sectional view of the clasp of FIG. 1, taken along the plane of line 5—5 of FIG. 1.
Figure 6:
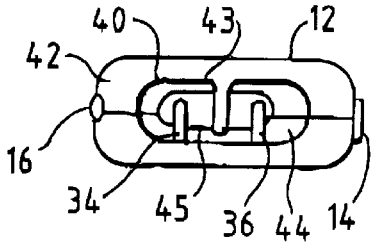
FIG. 6 is a plan view of the top of a clasp, without chains, made in accordance with the principles of the present invention.

It can also be seen in FIG. 2, and more particularly in FIG. 5, that anchors 34, 36 and 38 are offset so that when clasp 12 is in a closed position, anchors 34, 36 and 38 are separate. In this way the ends of the chain 20 and pendant 18 do not interfere with each other. It is to be understood, however, that the anchors may be placed in any position, as shown (for example) in FIG. 10, without departing from the novel scope of the present invention.

Figure 7:
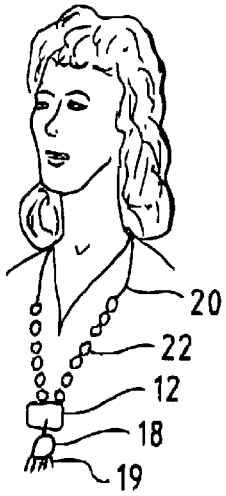
FIG. 7 is a perspective view of a person wearing a piece of chain jewelry utilizing a clasp made in accordance with the principles of the present invention.

FIG. 7 shows the method of wearing a necklace, utilizing the clasp of the present invention, such that the clasp is worn on the chest in a decorative manner. While the clasp 12 is on the chest of the wearer, the wearer may easily reach and open clasp 12 for removal of the necklace or to add or remove chains and/or pendants. This manipulation of clasp 12 would occur in front of the user's eyes further facilitating the manipulation of clasp 12.

In the preparation and wearing of jewelry using the clasp of the present invention, referring again to FIGS. 1 and 2, the user would unlatch hasp 30 from knob 32 and rotate, about hinge 16, one portion of receptacle 12 away from the other portion. A chain 20, of any length (necklace, bracelet, anklet, watch, etc.), having eyelets 50, or having links 54 (FIGS. 3 and 4), is attached to anchors 34 and 36 of clasp 12. A pendant 18, or other chain jewelry, fob or hanging device, may be attached to any of the remaining anchors, and clasp 12 may then be closed and locked.

Figure 8:
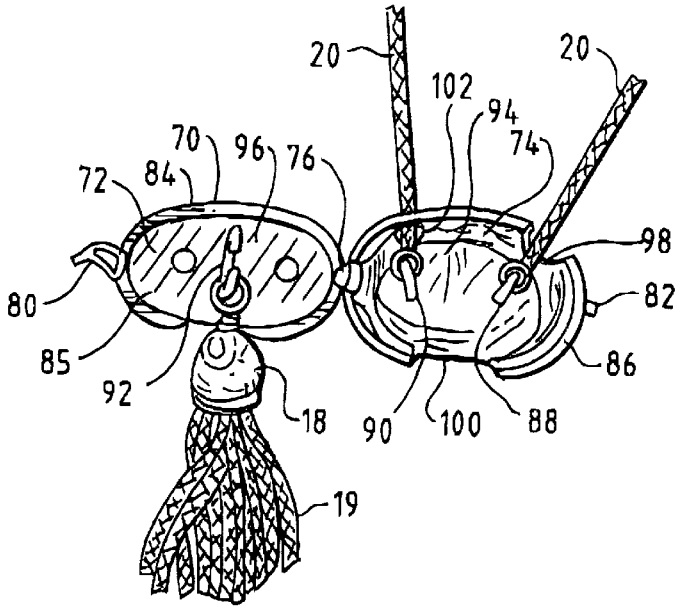
FIG. 8 is a perspective view of the preferred embodiment of a clasp, made in accordance with the principles of the present invention, in an open position.
Figure 9:
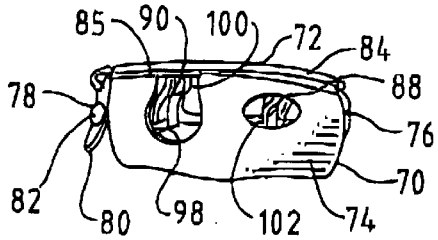
FIG. 9 is a perspective view of the top of the clasp of FIG. 9

Referring to FIGS. 8 and 9, the preferred embodiment of the present invention is shown. Clasp 70 comprising a lid portion 72 and a container portion 74 is shown. A hinge 76 is provided to rotatably connect lid 72 to container 74 and a lock 78 is also provided. Lock 78 comprises a hasp 80 defined on lid portion 72 and a knob 82 defined on container portion 74. Clasp 70 is very similar to clasp 12 shown in FIG. 1.

The lid portion of clasp 70 defines a rim 84 surrounding a plate 85. Plate 85 extends downwardly from rim 84, such that plate 85 tightly fits into container portion 74. Container portion 74 also defines a rim portion 86. When lid portion 72 and container portion 74 are rotated together a tight fit is formed when plate 85 and rim portion 86 are fitted together. In this way, a chain 20 and pendant 18 are securely held within clasp 70. Rim portions 84 and 86 and plate 85 provide increased security against the loss of the jewelry, due to the opening of the clasp, as a friction fit between lid portion 72 and container portion 74 is created.

Clasp 70 defines three anchors 88, 90 and 92 which are all shown releasably attached to, respectively, chain 20 and pendant 18. As shown in FIG. 8, anchors 88 and 90 are defined on the inside wall 94 of container portion 74 and anchor 92 is defined on the inside wall 96 of lid portion 72. FIG. 8 further illustrates that a top cut out 98 and a bottom cut out 100 are defined in container portion 74. It can be seen (FIG. 9) that the top wall 74*a* of container 74 further defines and opening 102, through which a chain 20 may be inserted and attached to anchor 90 within clasp 70. It is to be understood that a chain may be threaded in through opening 102 and attached to any of the anchors 88, 90 or 92 of clasp 70 to achieve a desired fashion result.

Figure 10:
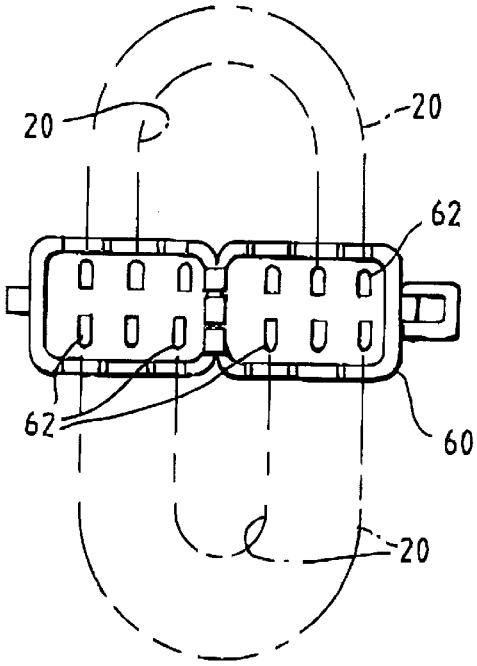
FIG. 10 is a perspective view of another embodiment of the clasp of the present invention, shown with possible connections of chain jewelry to anchors within the clasp.

Referring to FIG. 10, a clasp 60 having twelve anchor spots 62 is shown. In such a configuration a number of chains, fobs or other jewelry pieces may be joined together to form a variety of new combinations of jewelry, dependent only on the taste of the wearer. It is to be understood that any number of anchor spots may be provided in a clasp of the present invention without departing from the novel scope of the present invention.

Although illustrative embodiments of the invention have been shown and described, it is to be understood that various modifications and substitutions may be made by those skilled in the art without departing from the novel spirit and scope of the invention.

What is claimed is:

1. A jewelry clasp, for use with jewelry chains, comprising:

a receptacle divided into a first portion and a second portion, said first portion defining an interior wall and said second portion defining an interior wall, said first and second portions further defining the exterior of said receptacle;

a plurality of anchors, one or more of said anchors being defined on said interior wall of said first portion of said receptacle and one or more of said anchors being defined on the interior wall of said second portion of said receptacle, for holding the ends, within the interior walls of the receptacle, of at least one jewelry chain, such that jewelry chains may be anchored to form a plurality of jewelry configurations.

2. The jewelry clasp of claim 1, including a connector rotatably connecting said first portion of said receptacle to said second portion of said receptacle.

3. The jewelry clasp of claim 1, including a lock for holding said first portion of said receptacle to said second portion of said receptacle.

4. The jewelry clasp of claim 1, including a hasp, attached to said first portion of said receptacle and a knob, defined on said second portion of said receptacle, for locking engagement with said hasp, such that said first and second portions of said receptacle may be rotated together to a closed position and locked.

5. The jewelry clasp of claim 1, wherein said receptacle comprises a box and said first portion of said receptacle is the bottom of said box and said second portion of said receptacle is the lid of said box.

6. A jewelry clasp, comprising:

a box having a first portion and a second portion, said first and second portion defining the exterior of said box and defining the interior walls of said box;

a hinge rotatably connecting said first portion of said box to said second portion of said box, said first and second portion forming said box when rotated to a first closed position;

a first and second anchor defined on the interior wall of said first portion of said box and a third anchor defined on the interior wall of said second portion of said box for, respectively, holding, within said box, the first end of a chain, the second end of a chain and an end of a second chain attached to a pendant;

a hasp, attached to said first portion of said box;

a knob, defined on said second portion of said box for locking engagement with said hasp, such that said first and second portions of said box may be held closed together.

7. The jewelry clasp of claim 6, including a jewelry chain having a first end and a second end, and a second chain having a pendant attached thereto, said first end of said chain being permanently held by said first anchor and said second end of said chain and said second chain having a pendant being releasably held, respectively, by said second and third anchors.

8. A method of wearing jewelry including the steps of:

providing a plurality of jewelry chains including at least one first jewelry chain;

providing a receptacle divided into a first portion and a second portion, said portions defining the exterior of said receptacle and defining the interior walls of said receptacle;

providing a connector rotatably connecting said first portion of said receptacle to said second portion of said receptacle;

providing a plurality of anchors, one or more of said anchors being defined on the interior wall of said first portion of said receptacle and one or more of said anchors being defined on the interior wall of said second portion of said receptacle for holding the ends of said one first jewelry chain or other of said plurality of jewelry chains within said receptacle;

rotating said first portion of said receptacle away from said second portion to an open position;

attaching either said one first jewelry chain or other of said plurality of jewelry chains to any number of said plurality of anchors, within the interior walls of the receptacle, and rotating said first portion of said receptacle toward said second portion of said receptacle, to a closed position; and suspending said receptacle from either said one first jewelry chain or other of said plurality of jewelry chains such that said receptacle rests on the chest of the wearer as a decoration when either said one first jewelry chain or other of said plurality of jewelry chains are worn about the neck of the wearer.

9. The method of wearing jewelry of claim 8, including the step of providing a lock to secure said first and second portion of said receptacle together.

10. The method of wearing jewelry of claim 8, including the step of permanently attaching one end of one jewelry chain to one of said plurality if anchors.

11. A method of repairing a piece of chain jewelry including the steps of:

providing at least one jewelry chain having a first broken end and a second end;

providing a receptacle divided into a first portion and a second portion, said portions defining the exterior of said receptacle and defining the interior walls of said receptacle;

providing a connector rotatably connecting said first portion of said receptacle to said second portion of said receptacle;

providing a plurality of anchors, one or more of said anchors being defined on the interior wall of said first portion of said receptacle and one or more of said anchors being defined on the interior wall of said second portion of said receptacle, for holding the ends of said jewelry chain within said receptacle;

rotating said first portion of said receptacle away from said second portion to an open position;

attaching a link of the first broken end of said broken jewelry chain to any one of said plurality of anchors and attaching said second end of said jewelry chain to another of said plurality of anchors; and rotating said first portion of said receptacle toward said second portion of said receptacle, to a closed position.

12. A jewelry clasp, for use with jewelry chains, comprising:

a receptacle divided into a first portion and a second portion, said first portion defining an interior wall and said second portion defining an interior wall, said first and second portions further defining the exterior of said receptacle;

a plurality of anchors, two of said anchors being defined on said interior wall of said first portion of said receptacle and one of said anchors being defined on the interior wall of said second portion of said receptacle, for holding the ends, within the interior walls of the receptacle, of at least one jewelry chain, such that jewelry chains may be anchored to form a plurality of jewelry configurations.

13. The jewelry clasp of claim 12, which said anchors on said interior walls of each of said first portion and said second portion are off-set relative to one another to prevent the entanglement of said jewelry chains.

* * * * *